US010742002B1

(12) United States Patent
Gozawa et al.

(10) Patent No.: US 10,742,002 B1
(45) Date of Patent: Aug. 11, 2020

(54) SPARK PLUG

(71) Applicant: NGK SPARK PLUG CO., LTD., Nagoya-shi, Aichi (JP)

(72) Inventors: Tatsuya Gozawa, Nagoya (JP); Daiki Goto, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/837,495

(22) Filed: Apr. 1, 2020

(30) Foreign Application Priority Data

May 7, 2019 (JP) ..... 2019-087429

(51) Int. Cl.
*H01T 13/02* (2006.01)

(52) U.S. Cl.
CPC ..... *H01T 13/02* (2013.01)

(58) Field of Classification Search
CPC ..... H01T 13/02
See application file for complete search history.

(56) References Cited

U.S. PATENT DOCUMENTS 8,912,716 B2 12/2014 Hwang et al.
2012/0242215 A1 9/2012 Hwang et al.

FOREIGN PATENT DOCUMENTS

JP 2012-199236 A 10/2012

*Primary Examiner* — Joseph L Williams
(74) *Attorney, Agent, or Firm* — Kusner & Jaffe

(57) ABSTRACT

A spark plug wherein the occurrence of pre-ignition and misfires in the spark plug are suppressed. The spark plug includes a cover portion, that covers a front end portion of a center electrode and a facing portion of a ground electrode from a front end side of the spark plug to form a pre-chamber space. The cover portion has injection holes that are through-holes. A metal shell volume A ($mm^3$) of a portion of the metal shell on the front side with respect to a rear end of the pre-chamber space and a thermal conductivity B (W/mK) of the metal shell at the normal temperature satisfy a formula (1): $3.6<A/B<98.0$. The metal shell volume A ($mm^3$) and a space volume C of the pre-chamber space satisfy a formula (2): $0.18<C/A<1.20$.

4 Claims, 2 Drawing Sheets

SPARK PLUG

FIELD OF THE INVENTION

The present invention relates to a spark plug.

BACKGROUND OF THE INVENTION

Spark plugs including an ignition chamber have been developed. For example, a pre-chamber ignition plug according to Japanese Unexamined Patent Application Publication No. 2012-199236 ("PTL 1") includes a cylindrical metal housing, and an ignition chamber cap that surrounds a center electrode and a ground electrode to form an ignition chamber. The ignition chamber cap has multiple orifices that allow an air-fuel mixture to flow into the ignition chamber from a combustion chamber. This ignition plug ignites in the ignition chamber, and injects torch-shaped flames into the combustion chamber through the orifices to burn an air-fuel mixture in the combustion chamber.

The ignition plug disclosed in PTL 1, however, has a structure where the ignition chamber is closed except for the orifices. Thus, the temperature inside the ignition chamber tends to rise at the ignition, which may cause pre-ignition. On the other hand, when the temperature inside the ignition chamber is excessively lowered, pressure loss and heat loss increase during combustion inside the ignition chamber, so that pressure and heat quantity of the injection into the main combustion chamber decrease, which may cause misfires. Therefore, a configuration that can suppress pre-ignition and misfires has been desired by setting thermal conductivity and the volume to appropriate values in a housing and an ignition chamber cap that significantly affect heat conduction in the ignition chamber.

SUMMARY OF THE INVENTION

The present invention has been made in view of the above-described circumstances, and aims to suppress occurrence of pre-ignition and misfires in a spark plug including a cover portion that forms a pre-chamber. The present invention can be embodied in the following forms.

(1) A spark plug includes a center electrode, a ground electrode that includes a facing portion facing a front end portion of the center electrode and forms a discharge gap between the facing portion and the front end portion of the center electrode, a cylindrical insulator that accommodates the center electrode therein with the front end portion of the center electrode being exposed from a front end of the insulator, a cylindrical metal shell that accommodates the insulator therein, and a cover portion that covers, from a front end side of the spark plug, the front end portion of the center electrode and the facing portion of the ground electrode to form a pre-chamber, the cover portion being joined to a front end of the metal shell and including an injection hole that is a through-hole. A metal shell volume A ($mm^3$) of a portion of the metal shell on the front end side with respect to a rear end of the pre-chamber and a thermal conductivity B (W/mK) of the metal shell at a normal temperature satisfy a formula (1):

$$3.6<A/B<98.0 \quad \text{formula (1).}$$

The metal shell volume A ($mm^3$) and a pre-chamber volume C ($mm^3$) of the pre-chamber satisfy a formula (2):

$$0.18<C/A<1.20 \quad \text{formula (2).}$$

In a spark plug according to an aspect of the present invention, the larger a metal shell volume A ($mm^3$) of a portion of the metal shell on the front end side with respect to the rear end of the pre-chamber is, the more heat is likely to be stored in the pre-chamber. On the other hand, the larger a thermal conductivity B (W/mK) of the metal shell at a normal temperature is, the more heat is likely to be dissipated from the pre-chamber to the outside. Therefore, when the relationship between the metal shell volume A ($mm^3$) of a portion of the metal shell on the front end side with respect to the rear end of the pre-chamber and the thermal conductivity B (W/mK) of the metal shell at the normal temperature is defined by the above formula (1), the balance between the element facilitating heat storage in the pre-chamber and the element facilitating heat dissipation from the pre-chamber to the outside is improved. Thus, the temperature inside the pre-chamber can be maintained appropriately, so that pre-ignition and misfires can be prevented.

In the spark plug, the larger a pre-chamber volume C ($mm^3$) of the pre-chamber is, the more heat is likely to be dissipated from the pre-chamber to the outside. Therefore, when the relationship between the metal shell volume A ($mm^3$) of a portion of the metal shell on the front end side with respect to the rear end of the pre-chamber and the pre-chamber volume C ($mm^3$) of the pre-chamber is defined by the above formula (2), the balance between the element facilitating heat storage in the pre-chamber and the element facilitating heat dissipation from the pre-chamber to the outside is improved. Thus, the temperature inside the pre-chamber can be maintained appropriately, so that pre-ignition and misfires can be prevented.

(2) In the spark plug described in (1) above, the metal shell volume A ($mm^3$) and the pre-chamber volume C ($mm^3$) satisfy a formula (3):

$$0.36<C/A<0.58 \quad \text{formula (3)}$$

The spark plug according to an aspect of the present invention employing the formula (3) further improves the balance between the element facilitating heat storage in the pre-chamber and the element facilitating heat dissipation from the pre-chamber to the outside. Thus, the temperature inside the pre-chamber can be maintained more appropriately, so that pre-ignition and misfires can be further prevented.

(3) In the spark plug described in (1) or (2) above, the metal shell volume A ($mm^3$) and the thermal conductivity B (W/mK) satisfy a formula (4):

$$9.8<A/B<42.5 \quad \text{formula (4).}$$

The spark plug according to an aspect of the present invention employing the formula (4) further improves the balance between the element facilitating heat storage in the pre-chamber and the element facilitating heat dissipation from the pre-chamber to the outside. Thus, the temperature inside the pre-chamber can be maintained more appropriately, so that pre-ignition and misfires can be further prevented.

DETAILED DESCRIPTION OF INVENTION

First Embodiment

Hereinafter, a first embodiment of a spark plug 100 will be described in detail with reference to the drawings. In the following description, the lower side in FIG. 1 is referred to as a front end side (front side) of the spark plug 100, and the upper side in FIG. 1 is referred to as a rear end side of the spark plug 100.

Figure 1:
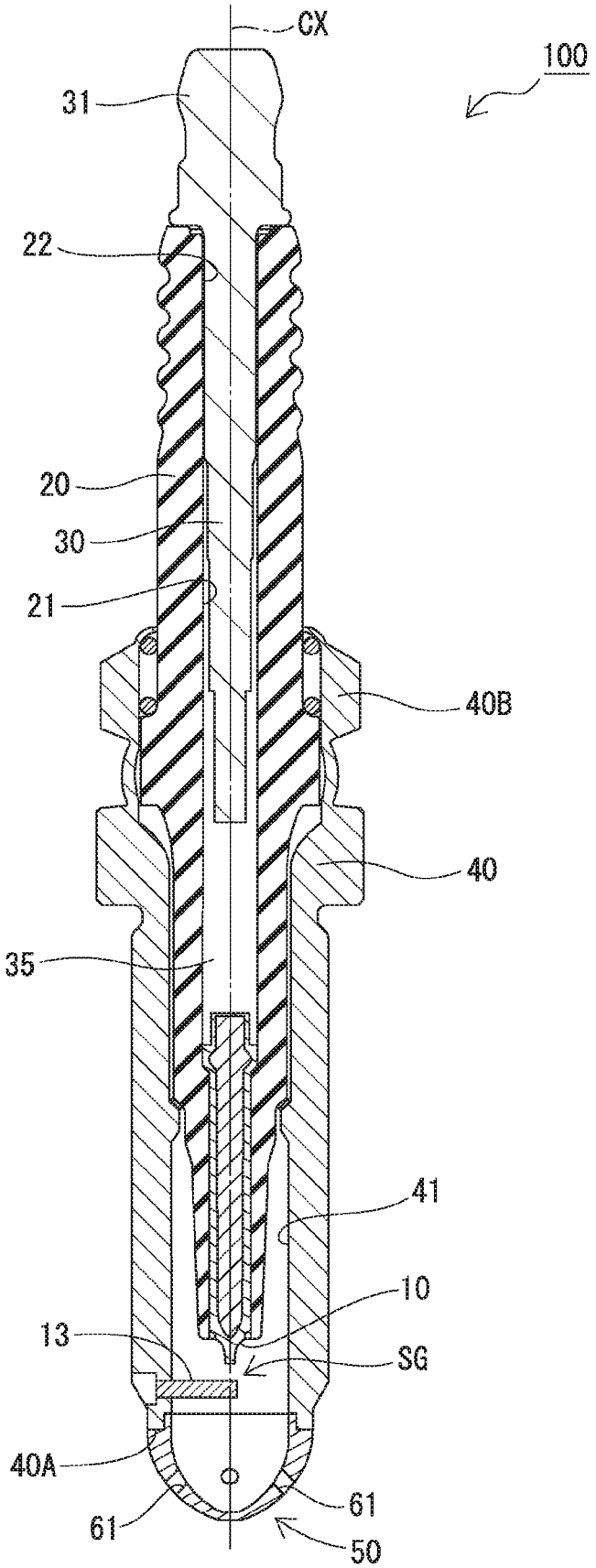
FIG. 1 is a cross-sectional view of a structure of a spark plug according to a first embodiment.

FIG. 1 is a cross-sectional view of a schematic structure of the spark plug 100 according to the first embodiment. In FIG. 1, a center axial line CX of the spark plug 100 (an axial line of the spark plug) is drawn with a dot-and-dash line.

The spark plug 100 is mounted on an internal combustion engine and used to ignite an air-fuel mixture in a combustion chamber. When mounted on the internal combustion engine, the front end side of the spark plug 100 (lower side in the drawing) is disposed inside the combustion chamber of the internal combustion engine, and the rear end side (upper side in the drawing) is disposed outside the combustion chamber. The spark plug 100 includes a center electrode 10, a ground electrode 13, an insulator 20, a terminal electrode 30, and a metal shell 40.

The center electrode 10 is constituted by a shaft-shaped electrode member and disposed in such a manner that a center axis thereof is coincident with the center axial line CX of the spark plug 100. The center electrode 10 is held by the metal shell 40 with the insulator 20 interposed therebetween in such a manner that a front end portion 11 is positioned on the rear end side (upper side in the drawing) with respect to a front-end-side opening portion 40A of the metal shell 40. The center electrode 10 is electrically connected to an external power source via the terminal electrode 30 disposed on the rear end side.

Figure 2:
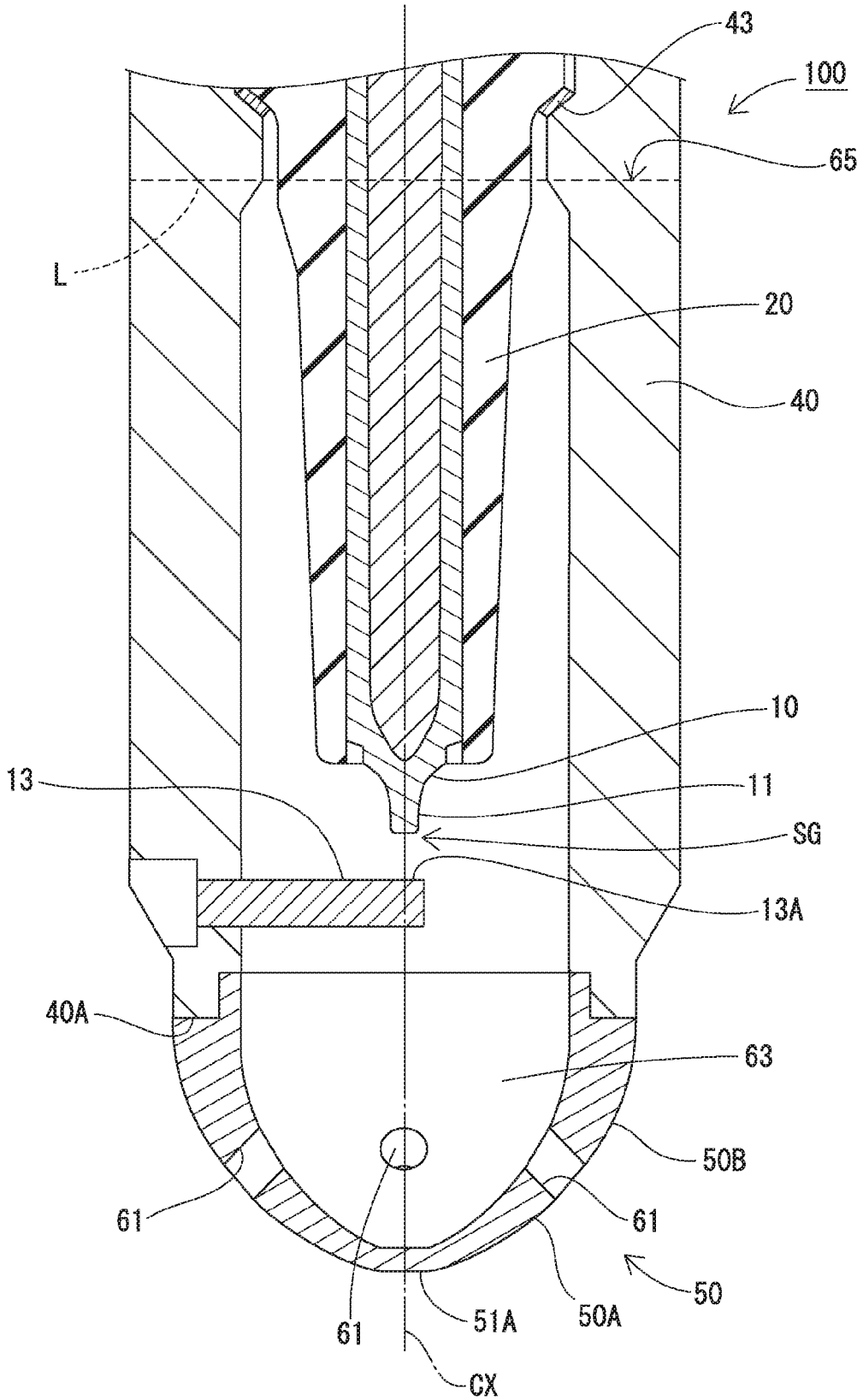
FIG. 2 is a partially enlarged cross-sectional view of the spark plug according to a first embodiment.

The ground electrode 13 is a rod-shaped electrode extending from a position slightly on the rear end side (upper side in the drawing) with respect to the front-end-side opening portion 40A of the metal shell 40 toward a position slightly on the front end side (lower side in the drawing) with respect to the front end portion 11 of the center electrode 10. Specifically, the ground electrode 13 is connected to the metal shell 40 at a position slightly on the rear end side (upper side in the drawing) with respect to the front-end-side opening portion 40A. The ground electrode 13 extends up to the front of the front end portion 11 of the center electrode 10. As illustrated in FIG. 2, the ground electrode 13 includes a facing portion 13A facing the front end portion 11 of the center electrode 10. A discharge gap SG is formed between the facing portion 13A of the ground electrode 13 and the front end portion 11 of the center electrode 10.

The insulator 20 is a cylindrical member including an axial hole 21 penetrating through the center thereof. The insulator 20 is constituted by, for example, a ceramic sintered body made of alumina or aluminum nitride. On the front end side of the axial hole 21 of the insulator 20, the center electrode 10 is accommodated with the front end portion 11 thereof being exposed. On the rear end side of the axial hole 21, the terminal electrode 30, which is a shaft-shaped electrode member, is held. A rear end portion 31 of the terminal electrode 30 extends out from a rear end opening portion 22 of the insulator 20 so as to be connectable with the external power source. The center electrode 10 and the terminal electrode 30 are electrically connected to each other via a resistor 35 that is held between glass sealing materials in order to suppress generation of radio interference noise when a spark discharge occurs. The center axis of the insulator 20 is coincident with the center axial line CX of the spark plug 100.

The metal shell 40 is a substantially cylindrical metal member including a cylinder hole 41 at the center thereof. The metal shell 40 is constituted of, for example, carbon steel. The center axis of the metal shell 40 is coincident with the center axial line CX of the spark plug 100. As described above, the ground electrode 13 is attached near the front-end-side opening portion 40A of the metal shell 40. A packing 43 is disposed between a diameter reduced portion inside the metal shell 40 and the insulator 20. The packing 43 is constituted by, for example, a metal material softer than a metal material constituting the metal shell 40.

The spark plug 100 includes a cover portion 50. The cover portion 50 has a dome shape. The cover portion 50 is constituted of, for example, stainless steel, nickel-based alloy, or copper-based alloy. The cover portion 50 is annularly joined to the front end of the metal shell 40 (more specifically, the front-end-side opening portion 40A). The cover portion 50 covers the front end portion 11 of the center electrode 10 and the facing portion 13A of the ground electrode 13 from the front side. The space surrounded by the cover portion 50 is a pre-chamber space (pre-chamber) 63. A rear end 65 of the pre-chamber space 63 is a portion where the inside of the metal shell 40 is reduced in diameter (a portion on which a broken line L in FIG. 2 passes). Specifically, the rear end 65 is a portion where the insulator 20 and the metal shell 40 are close to each other on the rear end side of the front end portion 11 of the center electrode 10. The cover portion 50 has its thickness gradually decreasing from the rear end side toward an apex 51A.

As illustrated in FIG. 2, the cover portion 50 has multiple injection holes 61 on the rear end side of the apex 51A. The cover portion 50 has, for example, four injection holes 61. Each of the injection holes 61 is a substantially cylindrical through-hole. The multiple injection holes 61 are positioned on a virtual circumference centered on the center axial line CX of the spark plug 100. The multiple injection holes 61 are arranged at equal intervals on the virtual circumference. The pre-chamber space 63, which is a space covered with the cover portion 50, functions as an ignition chamber, and communicates with the combustion chamber via the injection holes 61.

In the spark plug 100 according to the first embodiment, a metal shell volume A ($mm^3$) of a portion of the metal shell 40 on the front end side with respect to the rear end 65 of the pre-chamber space 63 (on the front end side with respect to the broken line L) and a thermal conductivity B (W/mK) of the metal shell 40 at the normal temperature satisfy formulas (1), (5) and (6):

$$3.6<A/B<98.0 \quad \text{formula (1),}$$

$$716\leq A\leq 2191 \quad \text{formula (5), and}$$

$$13\leq B\leq 372 \quad \text{formula (6).}$$

Further, the metal shell volume A ($mm^3$) of a portion of the metal shell 40 on the front end side with respect to the rear end 65 of the pre-chamber space 63 and a space volume (pre-chamber volume) C ($mm^3$) of the pre-chamber space 63 satisfy formulas (2) and (7):

$$0.18<C/A<1.20 \quad \text{formula (2), and}$$

$$259\leq C\leq 887 \quad \text{formula (7).}$$

The space volume C of the pre-chamber space 63 is a space surrounded by the cover portion 50 assumed to have no injection hole 61 (the cover portion 50 assumed to have a gently continuous inner surface with the injection holes 61 clogged), the metal shell 40, the center electrode 10, the earth electrode 13, and the insulator 20.

In the spark plug 100, the larger a metal shell volume A ($mm^3$) on the front end side with respect to the rear end 65 of the pre-chamber space 63 is, the more hear is likely to be stored in the pre-chamber space 63. On the other hand, the larger a thermal conductivity B (W/mK) of the metal shell 40 at a normal temperature is, the more heat is likely to be dissipated from the pre-chamber space 63 to the outside. Therefore, by employing a structure that satisfies 3.6<A/B<98.0, the balance between the element facilitating heat storage in the pre-chamber space 63 and the element facilitating heat dissipation from the pre-chamber space 63 to the outside is improved. Thus, the temperature inside the pre-chamber space 63 can be maintained appropriately, so that pre-ignition and misfires can be prevented.

In addition, in the spark plug 100, the larger a pre-chamber volume C ($mm^3$) of the pre-chamber space 63 is, the more heat is likely to be dissipated from the pre-chamber space 63 to the outside. Therefore, by employing a structure that satisfies 0.18<C/A<1.20, the balance between the element facilitating heat storage in the pre-chamber space 63 and the element facilitating heat dissipation from the pre-chamber space 63 to the outside is improved. Thus, the temperature inside the pre-chamber space 63 can be maintained appropriately, so that pre-ignition and misfires can be prevented.

In the spark plug 100 according to the first embodiment, the metal shell volume A ($mm^3$) of a portion of the metal shell 40 on the front end side with respect to the rear end 65 of the pre-chamber space 63 and the space volume C ($mm^3$) of the pre-chamber space 63 satisfy a formula (3), below:

$$0.36<C/A<0.58 \quad \text{formula (3).}$$

The spark plug 100 employing a structure that satisfies 0.36<C/A<0.58 further improves the balance between the element facilitating heat storage in the pre-chamber space 63 and the element facilitating heat dissipation from the pre-chamber space 63 to the outside. Thus, the temperature inside the pre-chamber space 63 can be maintained more appropriately, so that pre-ignition and misfires can be further prevented.

In the spark plug 100 according to the first embodiment, the metal shell volume A ($mm^3$) of a portion of the metal shell 40 on the front end side with respect to the rear end 65 of the pre-chamber space 63 and the thermal conductivity B (W/mK) of the metal shell 40 at the normal temperature satisfy a formula (4), below:

$$9.8<A/B<42.5 \quad \text{formula (4).}$$

The spark plug 100 employing a structure that satisfies 9.8<A/B<42.5 further improves the balance between the element facilitating heat storage in the pre-chamber space 63 and the element facilitating heat dissipation from the pre-chamber space 63 to the outside. Thus, the temperature inside the pre-chamber space 63 can be maintained more appropriately, so that pre-ignition and misfires can be further prevented.

EXAMPLES

The present invention will be more specifically described below using examples.

1. Experiment (Experiment Corresponding to First Embodiment)

(1) Method of Experiment

(1.1) Examples

Samples of the spark plug 100 illustrated in FIGS. 1 and 2 were used herein. Table 1, below, shows the detailed conditions. The spark plug 100 satisfies the requirements of the first embodiment. In Table 1, each experiment example is denoted with "No.". Nos. 1, 4, 7, 13, 14, 16 to 21, 23 to 26, 28 to 33, 35, 36, 42, 45, and 48 in Table 1 are examples.

(1.2) Comparative Examples

Samples of a spark plug having a structure different from that of the spark plug 100 illustrated in FIGS. 1 and 2 were used herein. Table 1, below, shows the detailed conditions. This spark plug does not satisfy the requirements of the first embodiment. Numbers marked with an asterisk "*", like "1*" in Table 1, denote that they are comparative examples. Specifically, Nos. 2, 3, 5, 6, 8 to 12, 15, 22, 27, 34, 37 to 41, 43, 44, 46, and 47 in Table 1 are comparative examples.

(2) Method for Evaluation

(2.1) Measurement of Metal Shell Volume a ($mm^3$) and Space Volume C ($mm^3$)

Using an X ray computed tomography (CT) scanner, each sample was scanned under the conditions of a tube voltage of 200 kV and a tube current of 120 μA. A three-dimensional image was manufactured from the scanning result for each sample, and the metal shell volume A ($mm^3$) of a portion of the metal shell 40 on the front end side with respect to the rear end of the pre-chamber space and the space volume C ($mm^3$) of the pre-chamber space were measured.

(2.2) Pre-Ignition Resistance Evaluation Test

Each sample underwent a pre-ignition resistance evaluation test. The summary of the pre-ignition resistance evaluation test is as follows. Each sample was mounted on an in-line four-cylinder naturally aspirated engine with a displacement of 1.3 L, and the engine was operated 1000 cycles of a series of processes on full throttle (6000 rpm) at an ignition angle (crank angle) of a predetermined initial value. During the engine operation, whether pre-ignition occurs was checked. When pre-ignition occurred, the ignition angle at that time was specified as a pre-ignition occurrence angle. When no pre-ignition occurred, the ignition angle was advanced by one degree, and the engine was activated again on full throttle to check whether pre-ignition occurs. This operation was performed repeatedly until pre-ignition occurs to specify the pre-ignition occurrence angle of each sample. Similarly, the pre-ignition occurrence angle of a reference spark plug (a genuine spark plug installed on a test engine) was specified. Then, the difference between the pre-ignition occurrence angle of the reference spark plug and the pre-ignition occurrence angle of each sample was calculated. When the pre-ignition occurrence angle is on more advanced side with respect to the reference spark plug, the spark plug is evaluated as having higher pre-ignition resistance. The pre-ignition occurrence angle of each sample with respect to that of the reference spark plug was evaluated based on the following standards, and each experiment example was given an evaluation score. The results are shown in the column "pre-ignition resistance" in Table 1.

<Evaluation of Pre-Ignition Resistance>

Each sample was evaluated with the following three grades. Higher evaluation scores represent higher pre-ignition resistance.

Evaluation Score:

3: Advanced by 5° CA or more with respect to the reference spark plug

1: Advanced by 2° CA or more and less than 5° CA with respect to the reference spark plug 0: Lagged or advanced by less than 2° CA with respect to the reference spark plug (2.3) Misfire Resistance Test Each sample underwent a misfire resistance evaluation test. The summary of the misfire resistance evaluation test is as follows. Each sample was mounted on an in-line four-cylinder direct-injection turbocharger engine with a displacement of 1.6 L, and the engine was operated 1000 cycles under the conditions of 2000 rpm and an intake pressure of 1000 kPa to measure the misfire rate. Spark plugs having a smaller misfire rate are evaluated as having higher misfire resistance (ignitability). The misfire rate of each sample was evaluated based on the following standards, and each experiment example was given an evaluation score. The results are shown in the column "misfire resistance" in Table 1.

<Evaluation of Misfire Resistance>

Each sample was evaluated with the following three grades. Higher evaluation scores represent higher misfire resistance.

Evaluation Score:

3: Misfire rate of lower than 1%

1: Misfire rate of 1% or higher and lower than 3%

0: Misfire rate of 3% or higher (2.4) Overall Evaluation

Based on the total score of the evaluation score for the pre-ignition resistance and the evaluation score for the misfire resistance, overall evaluation was made for each sample. Higher total scores are evaluated as being more preferable in both pre-ignition resistance and misfire resistance. The overall evaluation of a sample with the total score of 6 is denoted with "Excellent", the overall evaluation of a sample with the total score of 4 or 2 is denoted with "Good", and the overall evaluation of a sample with the total score of 3, 1, or 0 is denoted with "Poor". The results are shown in the column "overall evaluation" in Table 1.

TABLE 1

| No. | A: Volume of metal shell on front end side ($mm^3$) | B: Thermal conductivity of metal shell (W/mK ) | C: Pre-chamber volume ($mm^3$) | A/B | C/A | Pre-ignition resistance | Misfire resistance | Overall evaluation | |
|---|---|---|---|---|---|---|---|---|---|
| 1 | 716 | 13 | 259 | 55.1 | 0.36 | 1 | 3 | 4 | Good |
| 2* | 1312 | 13 | 259 | 100.9 | 0.20 | 0 | 1 | 1 | Poor |
| 3* | 2191 | 13 | 259 | 168.5 | 0.12 | 0 | 0 | 0 | Poor |
| 4 | 716 | 13 | 450 | 55.1 | 0.63 | 1 | 1 | 2 | Good |
| 5* | 1312 | 13 | 450 | 100.9 | 0.34 | 0 | 1 | 1 | Poor |
| 6* | 2191 | 13 | 450 | 168.5 | 0.21 | 0 | 1 | 1 | Poor |
| 7 | 716 | 13 | 683 | 55.1 | 0.95 | 1 | 1 | 2 | Good |
| 8* | 1312 | 13 | 683 | 100.9 | 0.52 | 0 | 3 | 3 | Poor |
| 9* | 2191 | 13 | 683 | 1168.5 | 0.31 | 0 | 1 | 1 | Poor |
| 10* | 716 | 13 | 887 | 55.1 | 1.24 | 1 | 0 | 1 | Poor |
| 11* | 1312 | 13 | 887 | 100.9 | 0.68 | 0 | 1 | 1 | Poor |
| 12* | 2191 | 13 | 887 | 168.5 | 0.40 | 0 | 3 | 3 | Poor |
| 13 | 716 | 53 | 259 | 13.5 | 0.36 | 3 | 3 | 6 | Excellent |
| 14 | 1312 | 53 | 259 | 24.8 | 0.20 | 3 | 1 | 4 | Good |
| 15* | 2191 | 53 | 259 | 41.3 | 0.12 | 3 | 0 | 3 | Poor |
| 16 | 716 | 53 | 450 | 13.5 | 0.63 | 3 | 1 | 4 | Good |
| 17 | 1312 | 53 | 450 | 24.8 | 0.34 | 3 | 1 | 4 | Good |
| 18 | 2191 | 53 | 450 | 41.3 | 0.21 | 3 | 1 | 4 | Good |
| 19 | 716 | 53 | 683 | 13.5 | 0.95 | 3 | 1 | 4 | Good |
| 20 | 1312 | 53 | 683 | 24.8 | 0.52 | 3 | 3 | 6 | Excellent |
| 21 | 2191 | 53 | 683 | 41.3 | 0.31 | 3 | 1 | 4 | Good |
| 22* | 716 | 53 | 887 | 13.5 | 1.24 | 0 | 3 | 3 | Poor |
| 23 | 1312 | 53 | 887 | 24.8 | 0.68 | 3 | 1 | 4 | Good |
| 24 | 2191 | 53 | 887 | 41.3 | 0.40 | 3 | 3 | 13 | Excellent |
| 25 | 716 | 130 | 259 | 5.5 | 0.36 | 3 | 3 | 6 | Excellent |
| 26 | 1312 | 130 | 259 | 10.1 | 0.20 | 3 | 1 | 4 | Good |
| 27* | 2191 | 130 | 259 | 16.9 | 0.12 | 3 | 0 | 3 | Poor |
| 28 | 716 | 130 | 450 | 5.5 | 0.63 | 3 | 1 | 4 | Good |
| 29 | 1312 | 130 | 450 | 10.1 | 0.34 | 3 | 1 | 4 | Good |
| 30 | 2191 | 130 | 450 | 16.9 | 0.21 | 3 | 1 | 4 | Good |
| 31 | 716 | 130 | 683 | 5.5 | 0.95 | 3 | 1 | 4 | Good |
| 32 | 1312 | 130 | 683 | 10.1 | 0.52 | 3 | 3 | 6 | Excellent |
| 33 | 2191 | 130 | 683 | 16.9 | 0.31 | 3 | 1 | 4 | Good |
| 34* | 716 | 130 | 887 | 5.5 | 1.24 | 0 | 1 | 1 | Poor |
| 35 | 1312 | 130 | 887 | 110.1 | 0.68 | 3 | 1 | 4 | Good |
| 36 | 2191 | 130 | 887 | 16.9 | 0.40 | 3 | 3 | 6 | Excellent |
| 37* | 716 | 372 | 259 | 1.9 | 0.36 | 0 | 3 | 3 | Poor |
| 38* | 1312 | 372 | 259 | 3.5 | 0.20 | 0 | 1 | 1 | Poor |
| 39* | 2191 | 372 | 259 | 5.9 | 0.12 | 1 | 0 | 1 | Poor |
| 40* | 716 | 372 | 450 | 1.9 | 0.63 | 0 | 1 | 1 | Poor |
| 41* | 1312 | 372 | 450 | 3.5 | 0.34 | 0 | 1 | 1 | Poor |
| 42 | 2191 | 372 | 450 | 5.9 | 0.21 | 1 | 1 | 2 | Good |

TABLE 1-continued

| No. | A: Volume of metal shell on front end side ($mm^3$) | B: Thermal conductivity of metal shell (W/mK ) | C: Pre-chamber volume ($mm^3$) | A/B | C/A | Pre-ignition resistance | Misfire resistance | Overall evaluation | |
|---|---|---|---|---|---|---|---|---|---|
| 43* | 716 | 372 | 683 | 1.9 | 0.95 | 0 | 1 | 1 | Poor |
| 44* | 1312 | 372 | 683 | 3.5 | 0.52 | 0 | 3 | 3 | Poor |
| 45 | 2191 | 372 | 683 | 5.9 | 0.31 | 1 | 1 | 2 | Good |
| 46* | 716 | 372 | 887 | 1.9 | 1.24 | 0 | 0 | 0 | Poor |
| 47* | 1312 | 372 | 887 | 3.5 | 0.68 | 0 | 1 | 1 | Poor |
| 48 | 2191 | 372 | 887 | 5.9 | 0.40 | 1 | 3 | 4 | Good |

(3) Evaluation Results (3.1) Pre-Ignition Resistance

The experiment examples 2, 3, 5, 6, 8, 9, 11, 12, 37, 38, 40, 41, 43, 44, 46, and 47 (comparative examples) in each of which the ratio A/B fails to satisfy the formula (1) (3.6<A/B<98.0) were rated 0 in evaluation scores for "pre-ignition resistance". The ratio A/B is a ratio of the metal shell volume A ($mm^3$) of a portion of the metal shell 40 on the front end side with respect to the rear end 65 of the pre-chamber space 63 to the thermal conductivity B (W/mK) of the metal shell 40 at the normal temperature. On the other hand, the experiment examples 1, 4, 7, 10, 13 to 36, 39, 42, 45, and 48 (examples) in each of which the ratio A/B satisfies the formula (1) (3.6<A/B<98.0) were rated 1 or 3 in evaluation scores for "pre-ignition resistance". Thus, the examples satisfying the formula (1) (3.6<A/B<98.0) suppressed pre-ignition as compared with the comparative examples.

The experiment examples 1, 4, 7, 10, 25, 28, 31, 34, 39, 42, 45, and 48 (examples) in each of which the ratio A/B fails to satisfy the formula (4) (9.8<A/B<42.5) were rated 1 in evaluation scores for "pre-ignition resistance". On the other hand, the experiment examples 13 to 24, 26, 27, 29, 30, 32, 33, 35, and 36 (examples) in each of which the ratio A/B satisfies the formula (4) (9.8<A/B<42.5) were rated 3 in evaluation scores for "pre-ignition resistance". Thus, the examples satisfying the formula (4) (9.8<A/B<42.5) further suppressed pre-ignition.

(3.2) Misfire Resistance

The experiment examples 3, 10, 15, 22, 27, 34, 39, and 46 (comparative examples) in each of which the ratio C/A fails to satisfy the formula (2) (0.18<C/A<1.20) were rated 0 in evaluation scores for "misfire resistance". The ratio C/A is a ratio of the metal shell volume A ($mm^3$) of a portion of the metal shell 40 on the front end side with respect to the rear end 65 of the pre-chamber space 63 to the space volume C ($mm^3$) of the pre-chamber space 63. On the other hand, the experiment examples 1, 2, 4 to 9, 11 to 14, 16 to 21, 23 to 26, 28 to 33, 35 to 38, 40 to 45, 47, and 48 (examples) in each of which the ratio C/A satisfies the formula (2) (0.18<C/A<1.20) were rated 1 or 3 in evaluation scores for "misfire resistance". Thus, the examples satisfying the formula (2) (0.18<C/A<1.20) suppressed misfires.

The experiment examples 2, 4 to 7, 9, 11, 14, 16 to 19, 21, 23, 26, 28 to 31, 33, 35, 38, 40 to 43, 45, and 47 (examples) in each of which the C/A fails to satisfy the formula (3) (0.36<C/A<0.58) were rated 1 in evaluation scores for "misfire resistance". On the other hand, the experiment examples 1, 8, 12, 13, 20, 24, 25, 32, 36, 37, 44, and 48 (examples) in each of which the ratio C/A satisfies the formula (3) (0.36<C/A<0.58) were rated 3 in evaluation scores for "misfire resistance". Thus, the examples satisfying the formula (3) (0.36<C/A<0.58) further suppressed misfires.

(3.3) Overall Evaluation

The experiment examples 1, 4, 7, 13, 14, 16 to 21, 23 to 26, 28 to 33, 35, 36, 42, 45, and 48 (examples) were rated 1 or larger in both evaluation scores for "pre-ignition resistance" and evaluation scores for "misfire resistance". Thus, these experiment examples suppressed both pre-ignition and misfires. Particularly, the experiment examples 13, 20, 24, 25, 32, and 36 (examples) were rated 6 in total scores, and preferably suppressed both pre-ignition and misfires.

Other Embodiments (Modifications)

The present invention is not limited to the above embodiments, and may be embodied in various different forms within the scope not departing from the gist of the invention.

(1) In the above embodiments, the cover portion has a specific shape, but the shape is changeable as appropriate. The cover portion may have, for example, a circular cylindrical shape, a quadrangular box shape, or a conical shape.

(2) In the above embodiments, a spark plug having a specific number of injection holes is described as an example, but the number of injection holes is not limited to a specific one and changeable as appropriate. The arrangement of the injection holes and the penetrating direction of the injection hole are also changeable as appropriate.

What is claimed is:

1. A spark plug, comprising:

a center electrode;

a ground electrode that includes a facing portion facing a front end portion of the center electrode and forms a discharge gap between the facing portion and the front end portion of the center electrode;

a cylindrical insulator that accommodates the center electrode therein with the front end portion of the center electrode being exposed from a front end of the insulator;

a cylindrical metal shell that accommodates the insulator therein; and a cover portion that covers, from a front end side of the spark plug, the front end portion of the center electrode and the facing portion of the ground electrode to form a pre-chamber, the cover portion being joined to a front end of the metal shell and including an injection hole that is a through-hole, wherein a metal shell volume A ($mm^3$) of a portion of the metal shell on the front end side with respect to a rear end of the pre-chamber and a thermal conductivity B (W/mK) of the metal shell at a normal temperature satisfy a formula (1):

$$3.6<A/B<98.0,$$

wherein the metal shell volume A ($mm^3$) and a pre-chamber volume C ($mm^3$) of the pre-chamber satisfy a formula (2):

$$0.18<C/A<1.20.$$

2. The spark plug according to claim 1, wherein the metal shell volume A ($mm^3$) and the pre-chamber volume C ($mm^3$) satisfy a formula (3):

$$0.36<C/A<0.58.$$

3. The spark plug according to claim 1, wherein the metal shell volume A ($mm^3$) and the thermal conductivity B (W/mK) satisfy a formula (4):

$$9.8<A/B<42.5.$$

4. The spark plug according to claim 2, wherein the metal shell volume A ($mm^3$) and the thermal conductivity B (W/mK) satisfy a formula (4):

$$9.8<A/B<42.5.$$

* * * * *